US006609814B2

(12) United States Patent
Ahroni

(10) Patent No.: US 6,609,814 B2
(45) Date of Patent: Aug. 26, 2003

(54) APPARATUS, SYSTEMS, AND METHODS FOR MAINTAINING POWER TO A LIGHT STRING HAVING LIGHT UNITS ARRANGED IN SERIES

(76) Inventor: Joseph M. Ahroni, 6554 5th Pl., S., Seattle, WA (US) 98108

( * ) Notice: Subject to any disclaimer, the term of this patent is extended or adjusted under 35 U.S.C. 154(b) by 0 days.

(21) Appl. No.: 10/293,390

(22) Filed: Nov. 12, 2002

(65) Prior Publication Data

US 2003/0142494 A1 Jul. 31, 2003

Related U.S. Application Data

(63) Continuation of application No. 10/060,079, filed on Jan. 29, 2002.

(51) Int. Cl.[7] ..... F21V 23/04

(52) U.S. Cl. ..... 362/251; 362/249; 362/226; 362/252; 362/257; 362/391

(58) Field of Search ..... 362/251, 249, 362/226, 252, 257, 391, 806

(56) References Cited

U.S. PATENT DOCUMENTS

| | | | | |
|---|---|---|---|---|
| 4,107,765 | A | 8/1978 | Singleton et al. | 362/120 |
| 4,667,066 | A | 5/1987 | Ando et al. | 200/1 A |
| 5,139,343 | A | 8/1992 | Lin | 362/226 |
| 5,536,175 | A | 7/1996 | Forish | 439/57 |
| 5,829,865 | A | 11/1998 | Ahroni | 362/226 |
| 6,079,848 | A | 6/2000 | Ahroni | 362/249 |
| 6,533,437 | B1 * | 3/2003 | Ahroni | 362/249 |

OTHER PUBLICATIONS

Product Page –"Lightburst Display Lights".

* cited by examiner

*Primary Examiner*—Sandra O'Shea
*Assistant Examiner*—Mark Tsidulko
(74) *Attorney, Agent, or Firm*—Seed IP Law Group PLLC

(57) ABSTRACT

A light unit for use in a series circuit has a mechanical switch for providing an alternate circuit path around the leads of a bulb when the bulb is loose or removed. The mechanical switch is biased toward a closed position such that, when the bulb is removed from the light unit, the switch closes to provide the alternate circuit path. The switch is displaced to an open position when a bulb is secured to the light unit to break the alternate circuit path and route electricity through the bulb. A shunt assembly having a high resistance element and a retainer can be secured within a socket cavity of the light unit.

10 Claims, 12 Drawing Sheets

APPARATUS, SYSTEMS, AND METHODS FOR MAINTAINING POWER TO A LIGHT STRING HAVING LIGHT UNITS ARRANGED IN SERIES

TECHNICAL FIELD

The present invention relates to light strings having light units arranged in series.

BACKGROUND OF THE INVENTION

Decorative light strings are highly popular in the United States, especially during November and December, in celebration of Christmas. Such light strings are typically used to decorate houses and business buildings, both indoors and outdoors, as well as trees, bushes, and yard ornaments. Indeed, it is reasonable to say that most, if not all, Americans have used decorative light strings in or around their homes, or at least certainly seen them aglow in numerous decorative lighting arrangements in all sorts of settings during the "holiday season."

Decorative light strings are commonly comprised of a plurality of individual light units with miniature bulbs, electrically connected in series. The miniature bulbs are typically incandescent bulbs, and as such, each has a filament formed between two leads of the bulb, the filament giving off light when a current is passed from one lead to the other, through the filament. As the bulb is used, over time, the filament will burn out, breaking the series circuit in which the bulb is arranged. This will cause the entire light string to go out unless a backup circuit path is available to bypass the failed filament.

To provide a backup circuit path, some decorative light strings are manufactured with bulbs having a shunt arranged in parallel with the filament of each bulb, both the shunt and filament being disposed between the two leads of the bulb. These shunts can be comprised of a conducting material with an insulating coating. When the filament is intact, current passes therethrough because the resistance of the filament is low compared to that of the insulating material on the shunt. However, when the filament burns out, the voltage across the leads of the bulb drives current across the shunt, burning off the insulating material of the shunt, and allowing it to conduct electricity between the two leads of the bulb, thereby providing a backup circuit path around the failed filament. In this manner, even if a bulb burns out, the rest of the light units in the light string remain on because the series circuit remains closed.

Despite the availability of decorative light strings having bulbs with shunts, problems still persist related to maintaining a complete circuit in the light strings. For example, although such light strings provide an alternate circuit path (i.e. a parallel shunt) when a bulb burns out, if the bulb itself is destroyed, removed or loose such that its leads are not in contact with the main conducting wire of the circuit, then the current path to both the shunt and filament are broken, and hence, the entire series circuit of the light string is broken. A user may then have to manually inspect each and every bulb of a light string to check if it is properly installed before being able to complete the circuit and restore the light string to working order. This problem arises so frequently that testing devices are reportedly sold to test for loose bulbs when a light string is not working properly. Also, the shunt of a bulb could be defective for various reasons, in which case, no backup circuit path is available when the bulb burns out. Again, this can result in the entire light string being inoperable and the user having to individually inspect each and every bulb of the light string to determine which bulb has failed, or is defective, and otherwise needs replacement.

The problems discussed above limit reliability of decorative light strings and result in significant inconvenience and hassle to users. There is a need for a more reliable design for decorative light strings that eliminates or significantly reduces the frequency with which they must be inspected and maintained.

BRIEF SUMMARY OF THE INVENTION

One embodiment of the present invention comprises a light unit for use with a light string having at least two light units connected in series. Each light unit includes a socket unit, or connection unit, that is connected to separate wire segments via contact elements. The wire segments make up the wire of the light string. A bulb assembly is receivable by the socket unit and can be removed and replaced when a filament of the bulb assembly burns out.

There is a mechanical switch in the socket unit that is operable between a closed position for providing a circuit path between the separate wire segments and an open position wherein the circuit path is broken. When the switch is closed, the circuit path provided by the switch is parallel to a circuit path through the bulb assembly of the light unit.

The bulb assembly has an actuating member that impinges against a moveable member of the switch to displace the switch from the closed position to the open position when the bulb assembly is received by the socket unit. The switch has a biasing component with a restoring force that repositions the switch from the open position to the closed position when the bulb assembly is removed or loosened from the socket unit.

In some embodiments, a shunt assembly is also provided that can be inserted within the socket unit, between the contact elements of the socket unit. The shunt assembly has a high resistance element and a non-conducting retainer. The retainer is made of an elastic (resilient) material to provide a restoring force when bent, and the high resistance element is attached to the retainer. The retainer is configured so that at least a portion thereof must be deformed against its restoring force in order to fit the retainer within the socket unit. The high resistance element is positioned on the retainer such when the retainer is inserted in the socket unit, the high resistance element is disposed between the retainer and the contact elements, with the restoring force of the retainer urging the high resistance element against the contact elements.

The present invention also includes embodiments of light strings having light units of various embodiments, including the embodiments disclosed above. Also, methods of operating light strings are provided. Some embodiments of such methods comprise passing current through a filament of a bulb to generate light until the filament fails and then removing the bulb from the light string to restore power to another light unit within the light string. In yet another embodiment, current is passed through a filament of a bulb until the filament fails, then passed through a primary shunt. The bulb is then replaced without replacing a secondary shunt, which is reused as a backup shunt.

DETAILED DESCRIPTION OF PREFERRED EMBODIMENTS

In the following description, certain specific details are set forth in order to provide a thorough understanding of various embodiments of the invention. However, upon reviewing this disclosure one skilled in the art will understand that the invention may be practiced without many of these details. In other instances, well known structures associated with decorative light strings and the individual light units thereof, have not been described in detail to avoid unnecessarily obscuring the descriptions of the embodiments of the invention.

U.S. Pat. No. 6,079,848 is incorporated herein in its entirety and discloses some light units contemplated for application of the present invention. Some elements of those light units are combined within various embodiments of the present invention described below. However, as will be appreciated, the present invention can be applied to almost any light string or system comprising two or more individual light units, or even one light unit and another power consuming device, when such device is electrically connected in series with the light unit.

Terms in the following description related to orientation such as "left" and "right," "up" and "down," and "vertical" and "horizontal," are only intended to describe the position or orientation of elements in relation to the figures in which they are illustrated, unless the context indicates otherwise.

Figure 1:
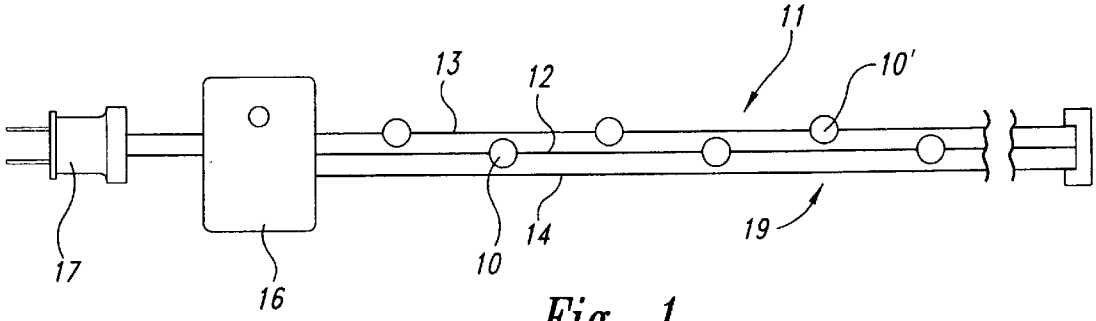
FIG. 1 is a schematic layout of one embodiment of a light set with which light units of the present invention can be used.
Figure 2:
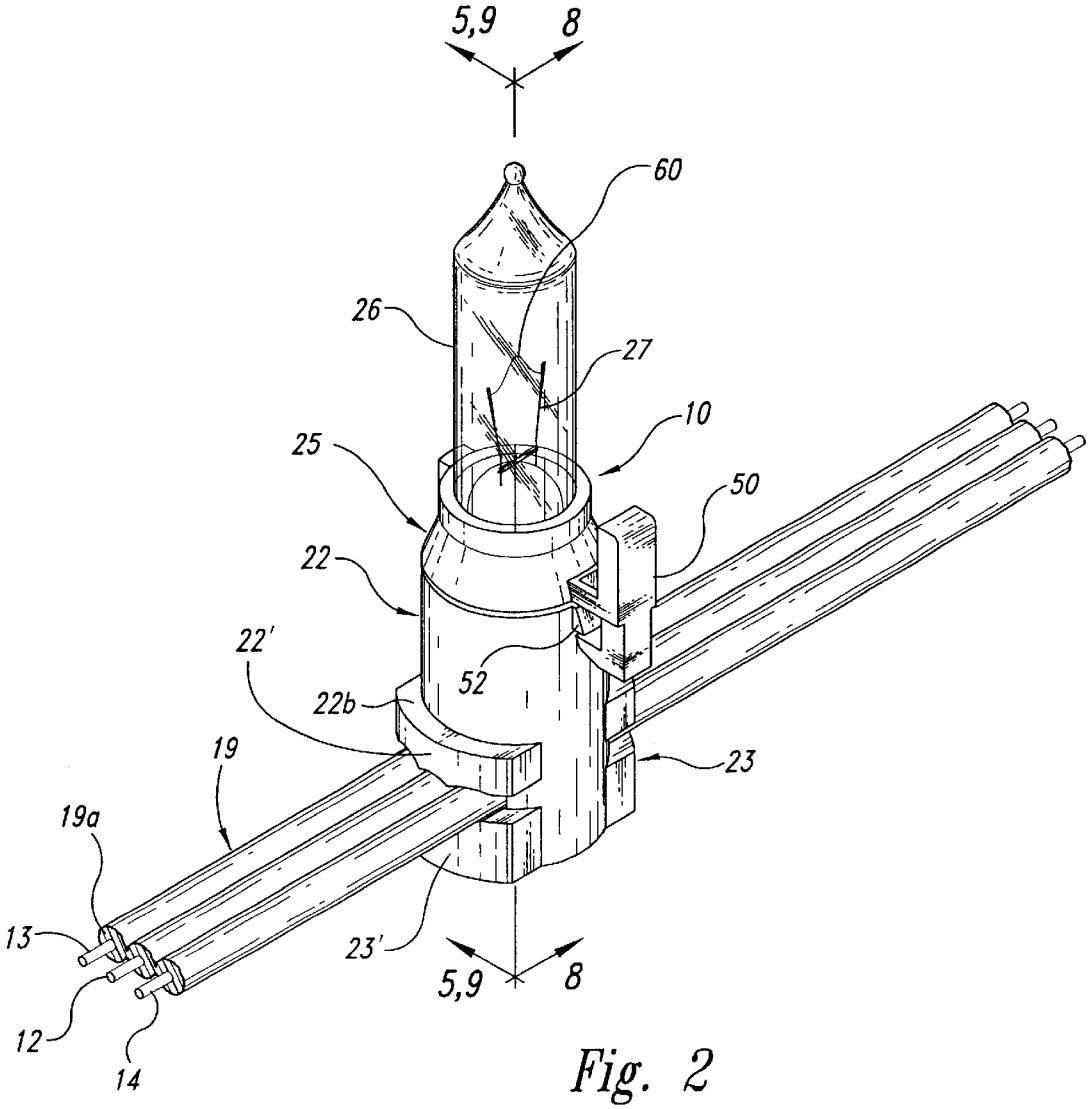
FIG. 2 is a perspective view of one of the light units mounted on a cord, the light unit being representative of one of a variety of embodiments of the present invention.

One embodiment of the present invention is applied to a chaser set 11 decorative light string, as illustrated in FIG. 1. The chaser set 11 has two series of light units 10, 10' on two interrupted wires 12, 13. The light units 10, 10' of each wire 12, 13 are connected in a series circuit along the wire. These wires and a return wire 14 extend from a controller 16, which is in turn, connected to a wall plug 17. The controller 16 contains a switching mechanism for alternately completing a circuit to the wires 12 and 13. As shown in FIG. 2, the wires 12–14 of the chaser set 11 are arranged in side-by-side spaced relation as part of a single cord 19 having insulation surrounding and separating the wires.

Figure 3:
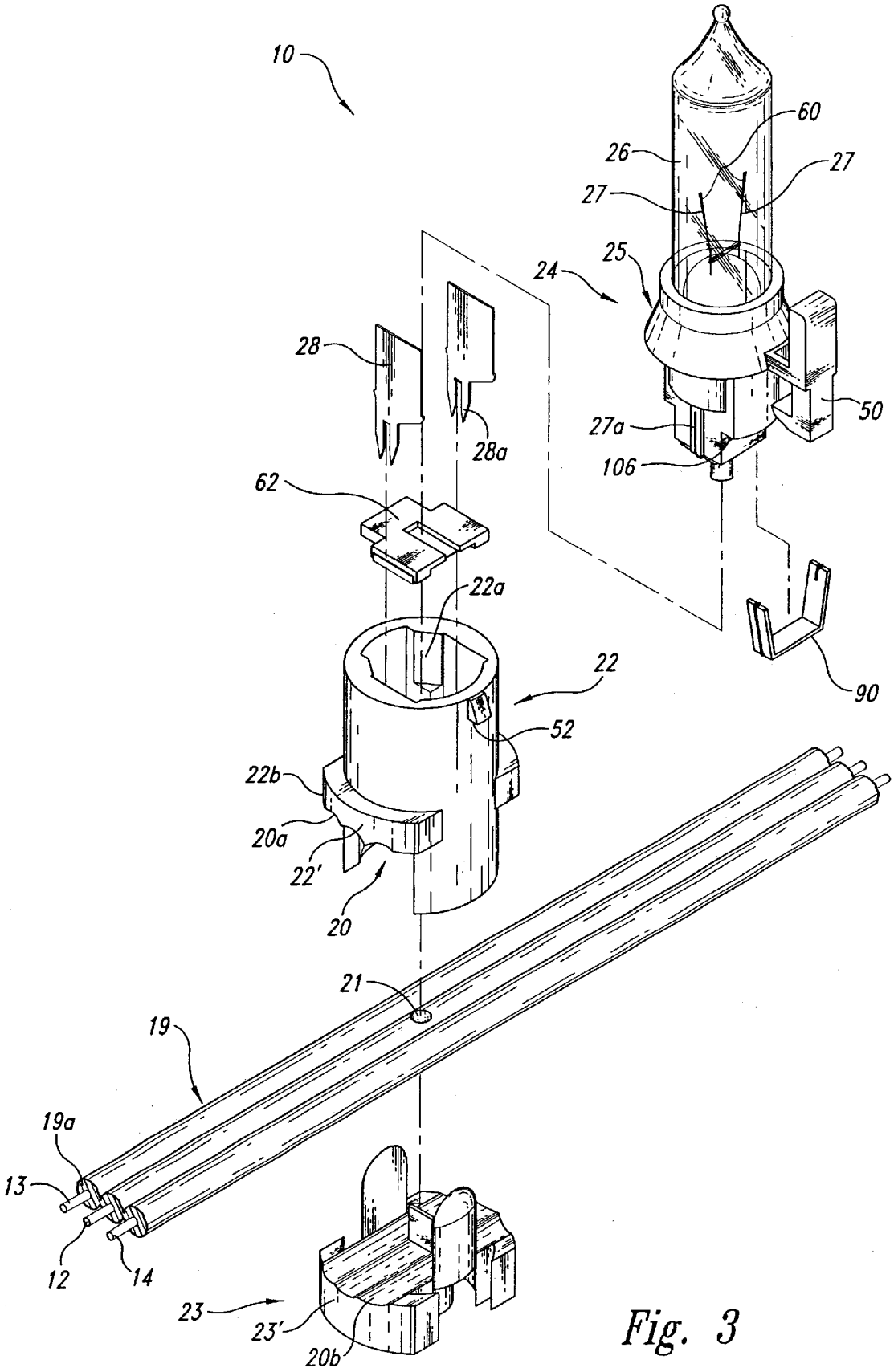
FIG. 3 is an exploded view of one embodiment of the present invention.

FIGS. 2 and 3 illustrate one possible embodiment for light units 10 of the present invention. Each light unit has a wireway 20 (FIG. 3) through which the cord 19 passes and the wires 12 are segmented, or sectioned, by respective cutouts 21 (FIG. 3) in the cord. The cutouts 21 are positioned in the wireways 20 of the light units 10. Each cutout 21 extends through only the respective wire 12 and the related external insulation. As can be seen in FIG. 5*b*, when the light units 10 are fully assembled within the chaser set 11, the resulting gap between the separate wire segments on each side of the cutouts 21 is bridged via a pair of contact elements 28 and the bottom portions of the leads 27*a* from a filament 60 of bulbs 26 in each light unit 10, in a manner to be described.

The light units 10 include an injection-molded two-piece plastic lampholder housing consisting of a socket unit 22, or connection unit, within which the electrical contact elements 28 are contained, and a base unit 23. The socket unit 22 and base unit 23 can have a snap interfit and can provide complementing gripping jaw portions 22', 23' forming the wireway 20 for passage of the cord 19. The illustrated wireway 20 is shaped by a set of three arcuate grooves 20*a* extending across the jaw portion of the socket unit 22 and a complementary set of three arcuate grooves 20*b* extending across the jaw portion 23' of the base unit 23. Within the wireway 20 the insulation 19*a* of the cord 19 can be firmly gripped and compressed between the opposing jaw portions 22', 23', as illustrated in FIG. 2.

As best seen in FIG. 3, a socket cavity 22*a* extends axially along the length of the socket unit 22 for receiving an insertion end portion of a bulb assembly 24 having an injection-molded plastic bulb holder 25 in which a bulb 26 is mounted. The bulb holder 25 and socket unit 22 can also comprise locking members 50, 52. Specifically, the bulb holder 25 can be provided with a locking finger 50 that mates with a stop shoulder 52 on the socket unit 22 when the bulb assembly 24 is pushed into the socket unit 22, to lock and secure the bulb assembly and socket unit together. The bulb assembly 24 can be released from the socket unit 22 by manually depressing an upper portion of the locking finger 50 and pulling the bulb assembly away from the socket unit.

The upper portions of a pair of leads 27 extend upward into each bulb 26 from a bottom section of the bulb. Within the bulb 26, a filament 60 extends between the upper portions of the leads 27, from one lead to the other, bridging a circuit path between the leads. The bottom portions of the leads 27*a* extend downward through the bottom of the bulb 26 and the bulb holder 25, and are thereafter folded upward along the sides of the bulb holder 25, as shown in FIG. 3. The leads 27*a* are configured such that when the bulb assembly 24 is pushed into the socket unit 22, they engage contact elements 28 located within the socket cavity 22*a* of the socket unit 22.

Figure 8:
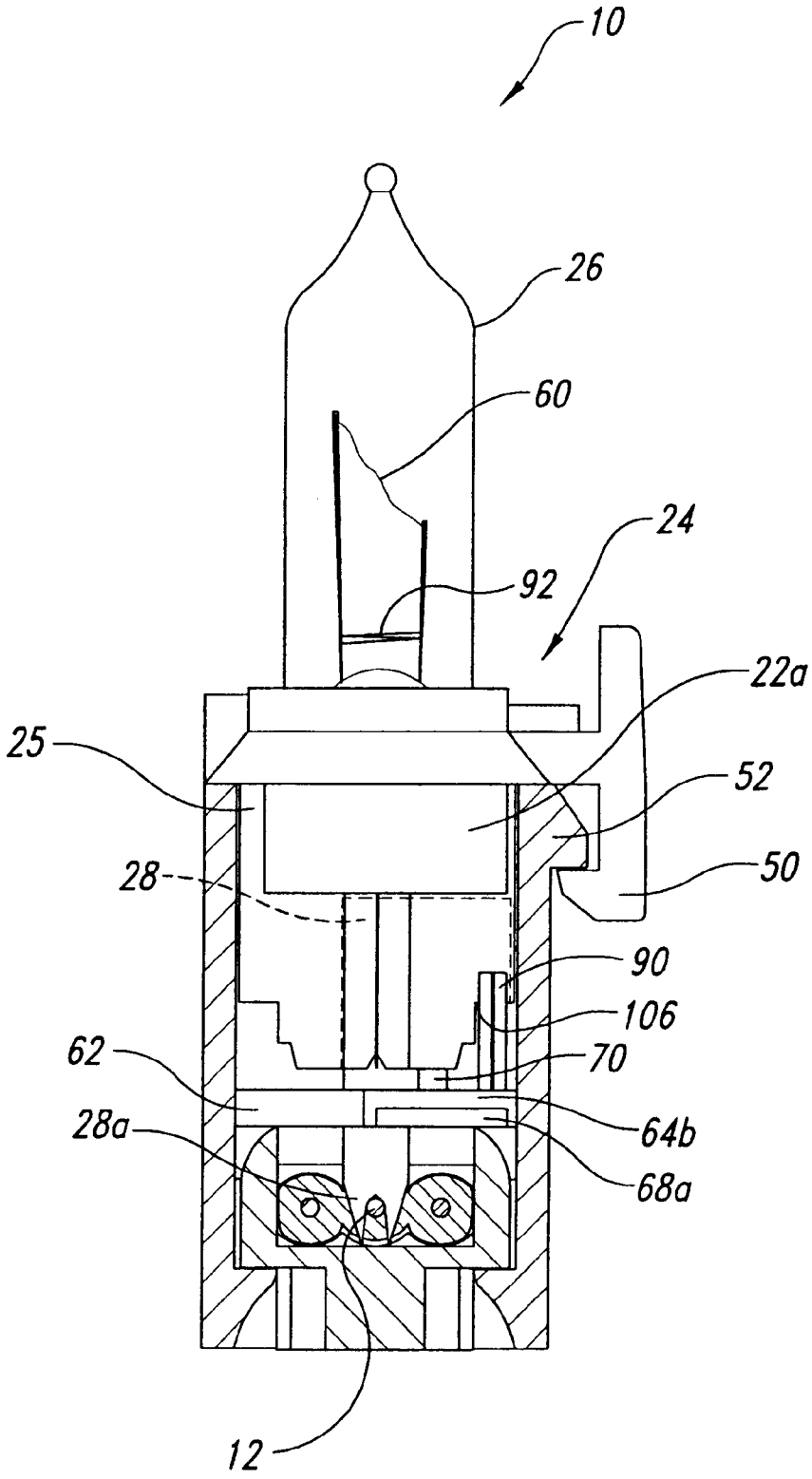
FIG. 8 is a cross sectional view of an embodiment of the switch assembly as viewed along line 8—8 in FIG. 2.

The contact elements 28 can be located at opposite sides of the socket cavity 22*a* and arranged to extend crosswise into the wireway 20 to engage opposite segments, or sections, of wire 12 separated by cutout 21. The bottom end portions of the contact elements 28 are bifurcated to provide a pair of sharp-ended prongs 28*a* that can be pushed through, or used to pierce, wire insulation 19*a* when assembling the light units 10. By pushing the prongs 28*a* through the insulation 19*a*, the contact elements 28 can then be positioned such that the segments of wire 12 are pinched between the prongs 28*a* to maintain contact between the contact elements 28 and the segments of wire 12, as illustrated in FIG. 8. As such, the contact elements 28 can be energized via wire 12 when the chaser set 11 is in use. FIG. 8 shows a contact element 28, with a part thereof illustrated in broken line, being disposed behind a bottom portion of an inserted bulb holder 25 and various other elements to be described.

Figure 5A:
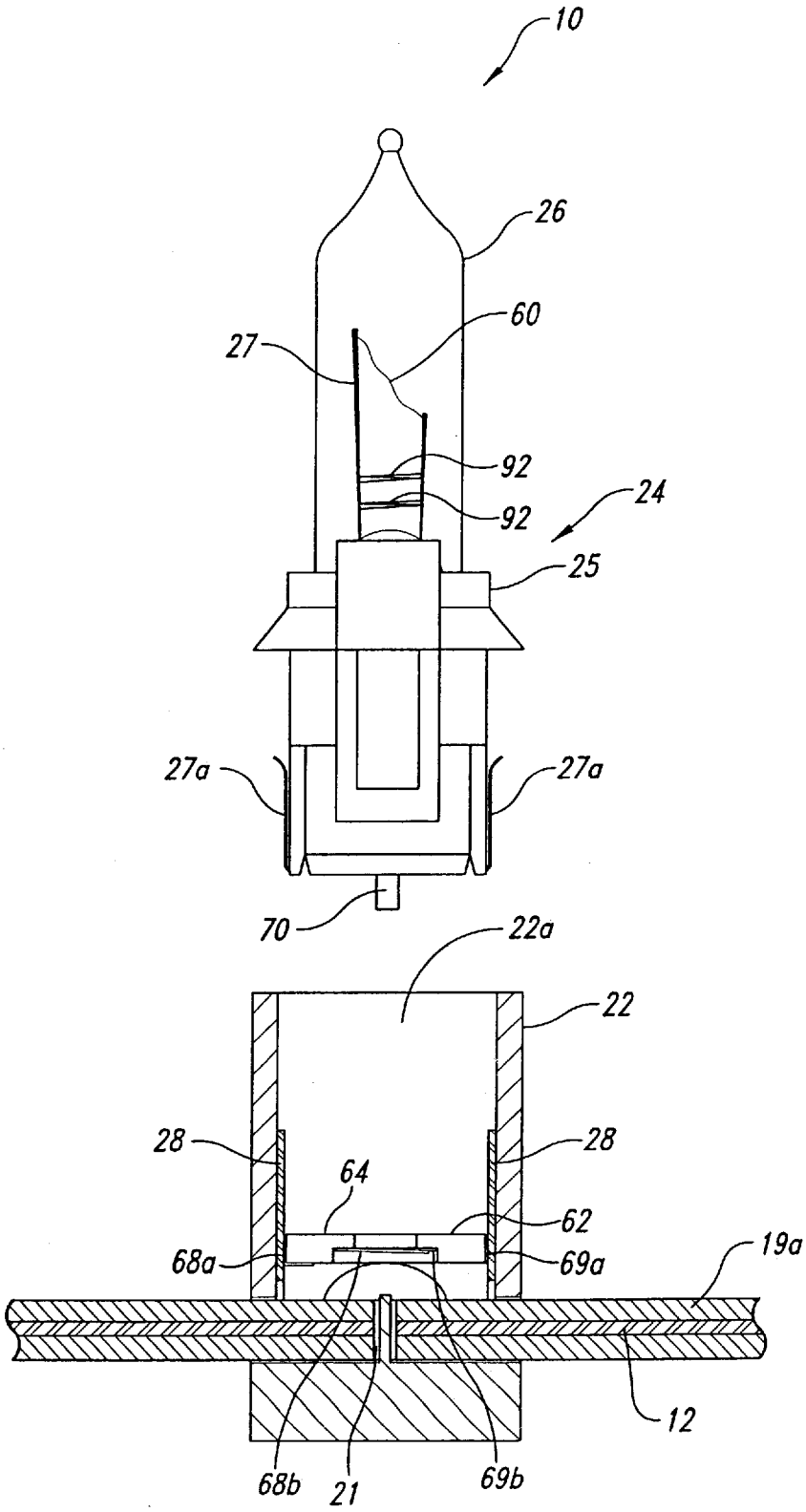
FIG. 5*a* is a cross sectional view along the line 5—5 of FIG. 2, showing an embodiment of the light unit of the present invention without an external shunt assembly disposed within the socket cavity and with the bulb assembly removed from the socket cavity.
Figure 5B:
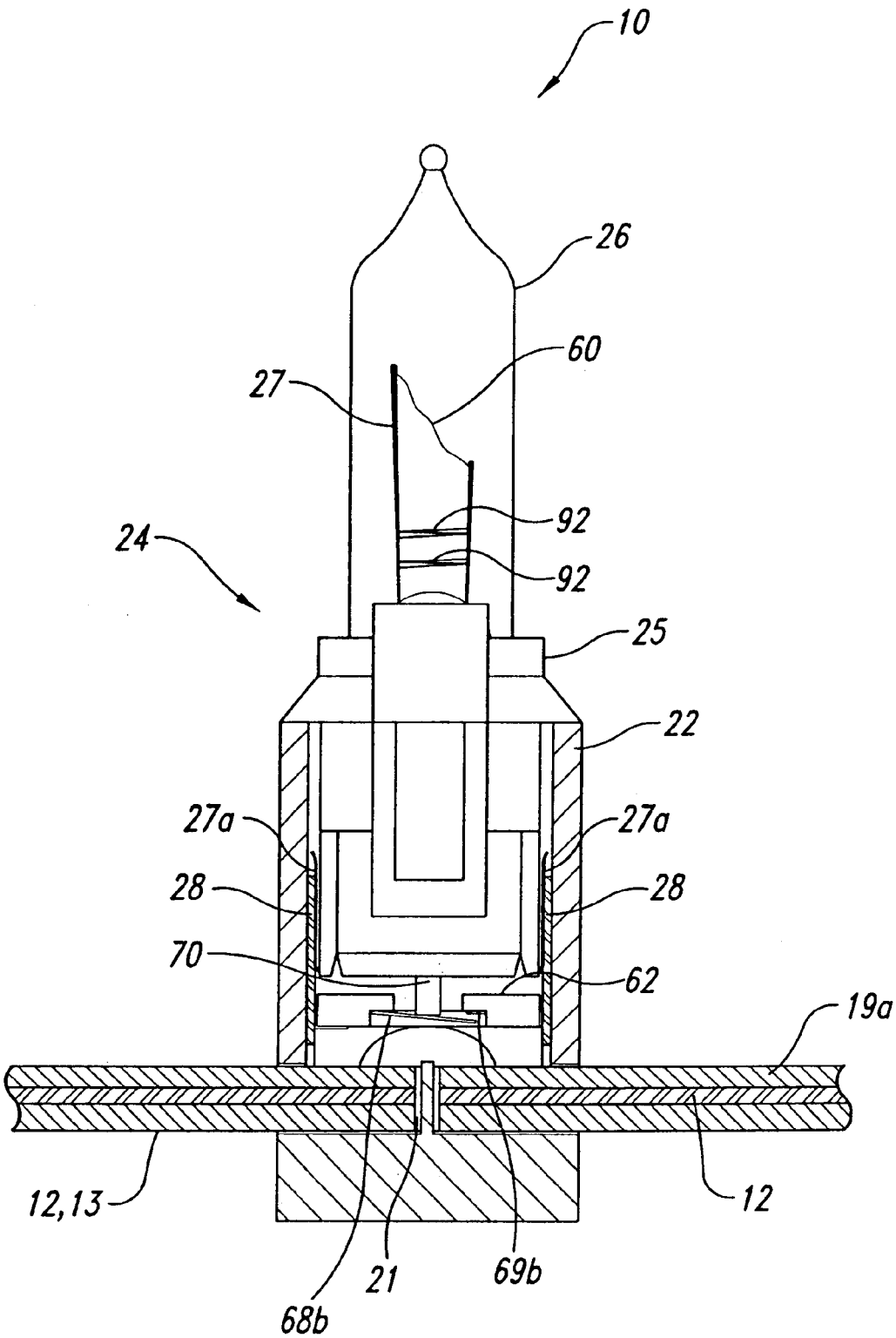
FIG. 5*b* is a cross sectional of view depicting the light unit of FIG. 5*a* with the bulb assembly inserted within the socket cavity of the socket unit.

In some embodiments of the light unit 10, such as those illustrated in FIGS. 5*a* and 5*b*, an automatic mechanical switch 62 is provided. In the illustrated embodiment, when the bulb assembly 24 is removed, or released, or loosened from the socket unit 22, the switch 62 closes to bridge a circuit path between the separate wire segments of the wire 12 to which the light unit is connected. This solves the prevalent problem in the field of decorative light strings of losing power to the entire light string when a single bulb is removed or loose. Conversely, when the bulb assembly is inserted in the socket unit 22, the switch 62 opens, breaking the circuit path through the switch to direct electricity through the bulb 26 of the bulb assembly 24. The present invention provides a highly cost effective and uncomplicated way to maintain power throughout a light string without having to inspect for loose bulbs. It also allows a user to removed bulbs 26 or bulb assemblies 24 from a light string without affecting power to the rest of the light string. After reviewing the present disclosure and figures, one of ordinary skill in the art will appreciate that other switch configurations can be substituted for the illustrated configurations without deviating from the spirit of the invention.

Figure 4A:
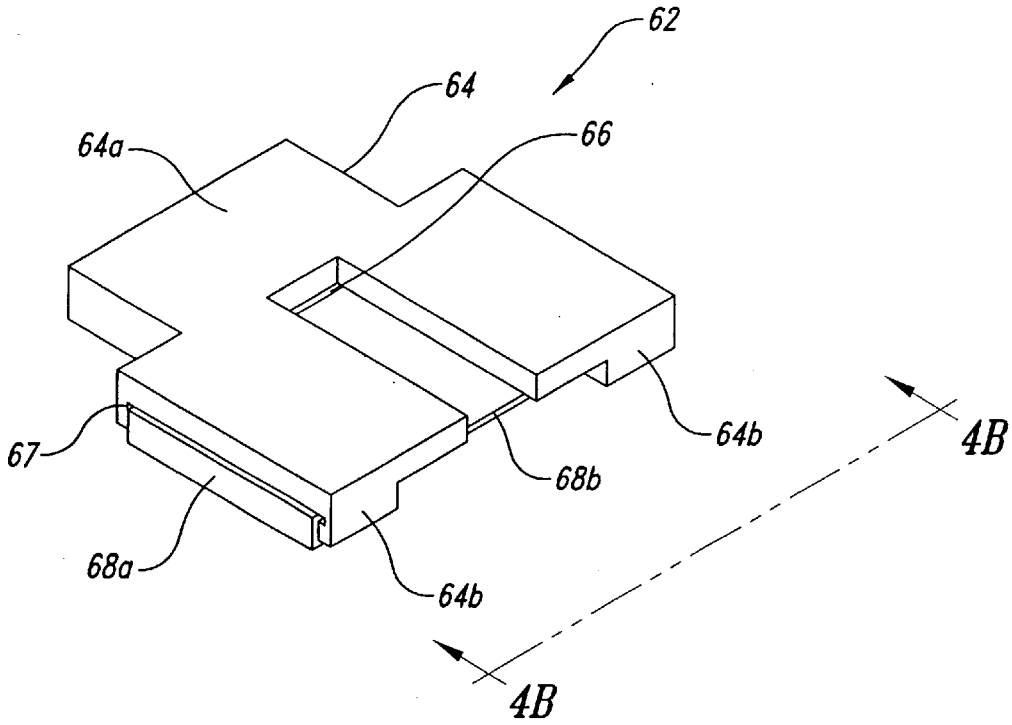
FIG. 4*a* is a perspective view of an embodiment of a switch assembly of the present invention.
Figure 4B:
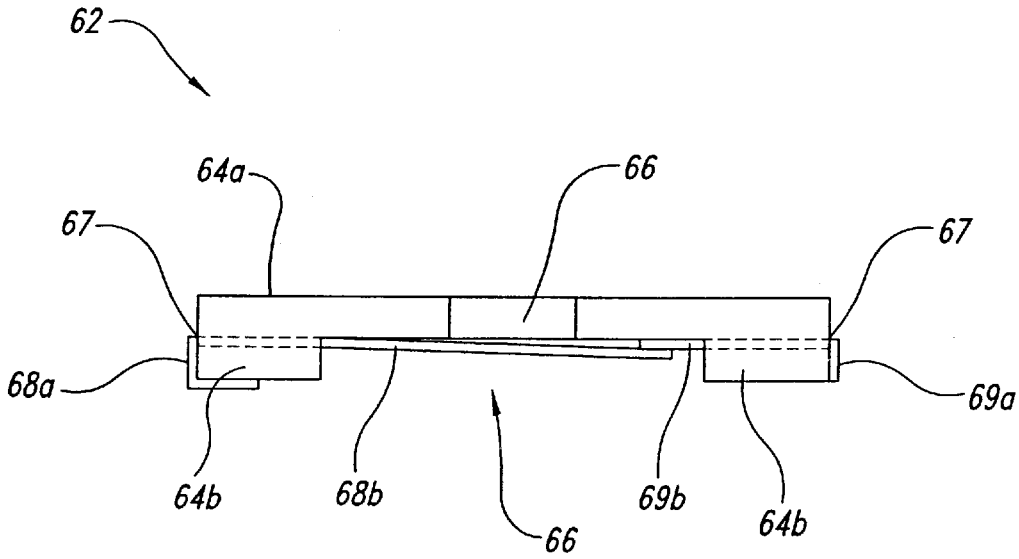
FIG. 4*b* is an elevation view of the switch of FIG. 4*a* as viewed from along the line 4*b* of FIG. 4*a*.

As can be seen in FIGS. 4*a* and 4*b*, one embodiment of the switch 62 comprises a plastic retaining member 64 and two flexible metal strips 68*a*, 69*a* that serve as conducting components of the switch. The retaining member 64 has a horizontal wall 64*a* that is partially bifurcated as viewed from above, forming left and right rectangular sections with a gap 66 therebetween. Left and right vertical walls portions 64*b*, extend downward from the outside edge of each respective left and right rectangular section of the horizontal wall 64*a*. Each vertical wall portion 64*b* has a horizontal slot 67 extending completely through the vertical wall portion from an outside surface of the vertical wall portion to an inside surface of the vertical wall portion. Also, as can be appreciated from reviewing FIG. 3, the contour of the retaining member 64 can be configured to compliment the contour of the socket cavity 22*a* to be insertable within the socket cavity. When the light unit is assembled, the switch 62 is disposed within the socket cavity 22*a* with the top surface of the horizontal wall 64*a* facing upward.

In some embodiments, when the switch 62 is fully assembled, one of the metal strips 68*b*, 69*b* extends through a respective one of the horizontal slots 67 of the retaining member 64. An outside portion of each metal strip 68*a*, 69*a* has a portion folded downward against an outside surface of the corresponding vertical wall portion 64*b*. These outside portions of the metal strips 68*a*, 69*a* can serve as mating faces for the switch 62 to be mated against the contact elements 28 of the socket unit 22, as illustrated by the embodiments shown in FIGS. 5*a* and 5*b*. In some embodiments, an end of the outside portion of one of the metal strips 68*a* is folded underneath a bottom part of the corresponding vertical wall portion 64*b*.

Referring back to FIGS. 4*a* and 4*b*, both of the metal strips 68*b*, 69*b* extend inward, toward one another, from the horizontal slots 67, underneath the horizontal wall portion 64*a*, with one of the metal strips 68*b* being longer than the other and extending beneath and across the gap 66 between the rectangular sections of the horizontal wall. A contact end portion of the longer metal strip 68*b* overlaps an end portion of the shorter metal strip 69*b* and is biased against the shorter metal strip so that opposite surfaces of the metal strips are in contact, thereby providing a circuit path through the metal strips. This can be seen in FIGS. 4*b* and 5*a*, which represent the switch in a closed position.

The longer metal strip 68*b* is positioned below the shorter metal strip 69*b* as viewed in FIG. 4*b* and serves as a moveable element of the switch 62. A contact end portion of the longer metal strip 68*b* is displaceable downward, away from the shorter metal strip 69*b* to disconnect the metal strips 68*b*, 69*b* from one another and open, or break the circuit path, of the switch 62 as represented in FIG. 5*b*. FIG. 5*b* shows the switch of FIG. 5*a* in the open position.

In the embodiments illustrated in FIGS. 5*a* and 5*b*, to operate the switch 62, the bulb assembly 24 is provided with an actuating member in the form of a actuating stub 70. The actuating stub 70 extends downward from a bottom portion, or the insertion end portion, of the bulb holder 25. When the insertion end portion of the bulb assembly 24 is inserted into the socket cavity 22*a* of the socket unit 22 to secure the bulb assembly thereto, the actuating stub 70 is aligned with and extends through the gap 66 between rectangular sections of the retaining member 64 of the switch. The actuating stub 70 thus impinges against the longer metal strip 68*b*, and displaces the contact end portion thereof downward and away from the shorter metal strip 69*b* to open the switch 62, as illustrated in FIG. 5*b*. Therefore, when a user secures the bulb assembly 24 to the socket unit 22, the switch 62 is automatically, or simultaneously, opened. In addition, the longer metal strip 68*b* can be configured as a spring having an inherent restoring force that biases the contact end portion thereof toward the shorter metal strip 69*b* to automatically restore the switch back to the closed position when the actuating stub 70 is not securely held against the metal strip 68*b*, such as when the bulb assembly 24 is released from the socket unit 22, or is loose by not being properly secured to the socket unit.

Figure 6A:
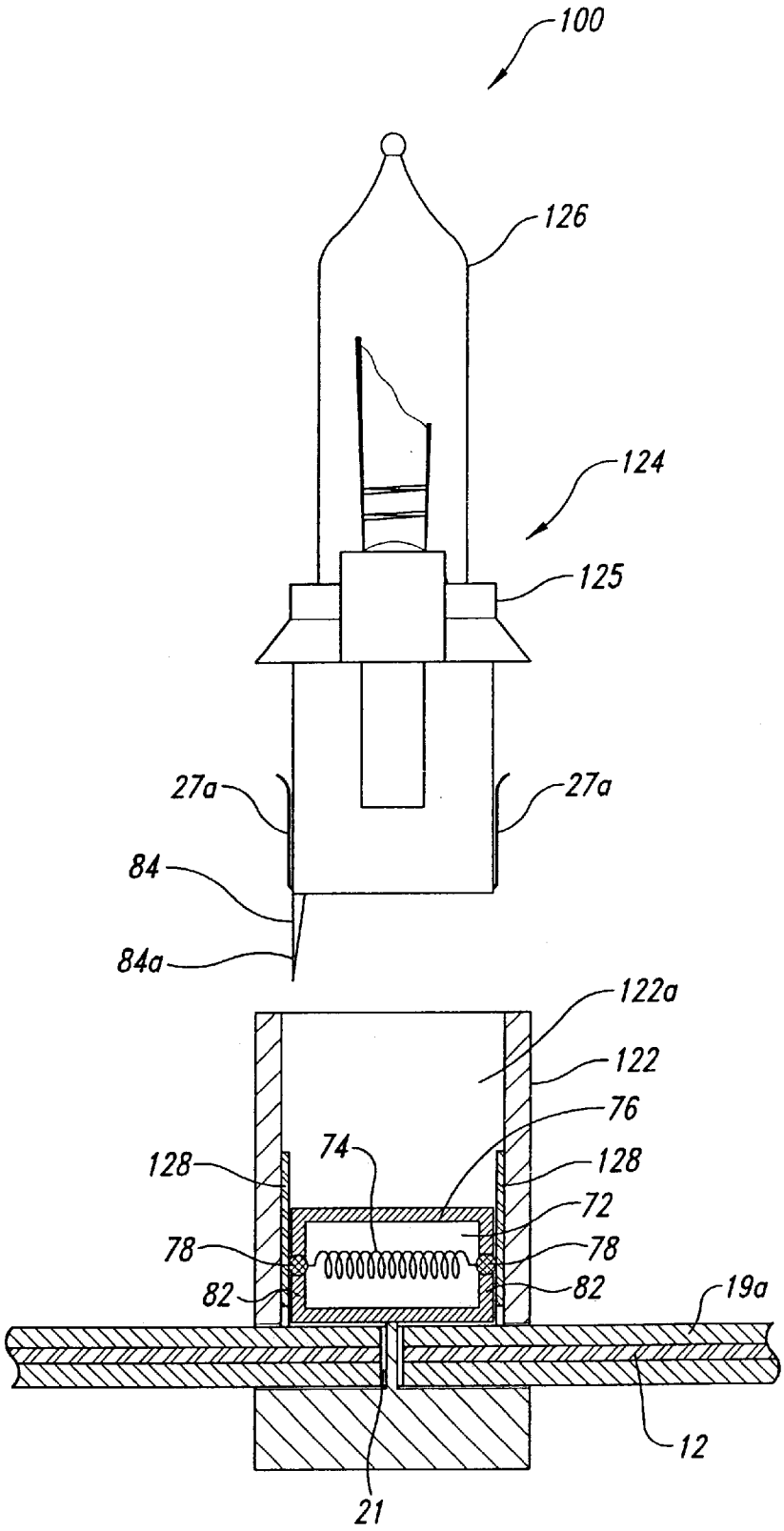
FIG. 6*a* is a cross sectional view of an embodiment of a light unit of the present invention as viewed laterally in relation to the cord to which the light unit is connected.
Figure 6B:
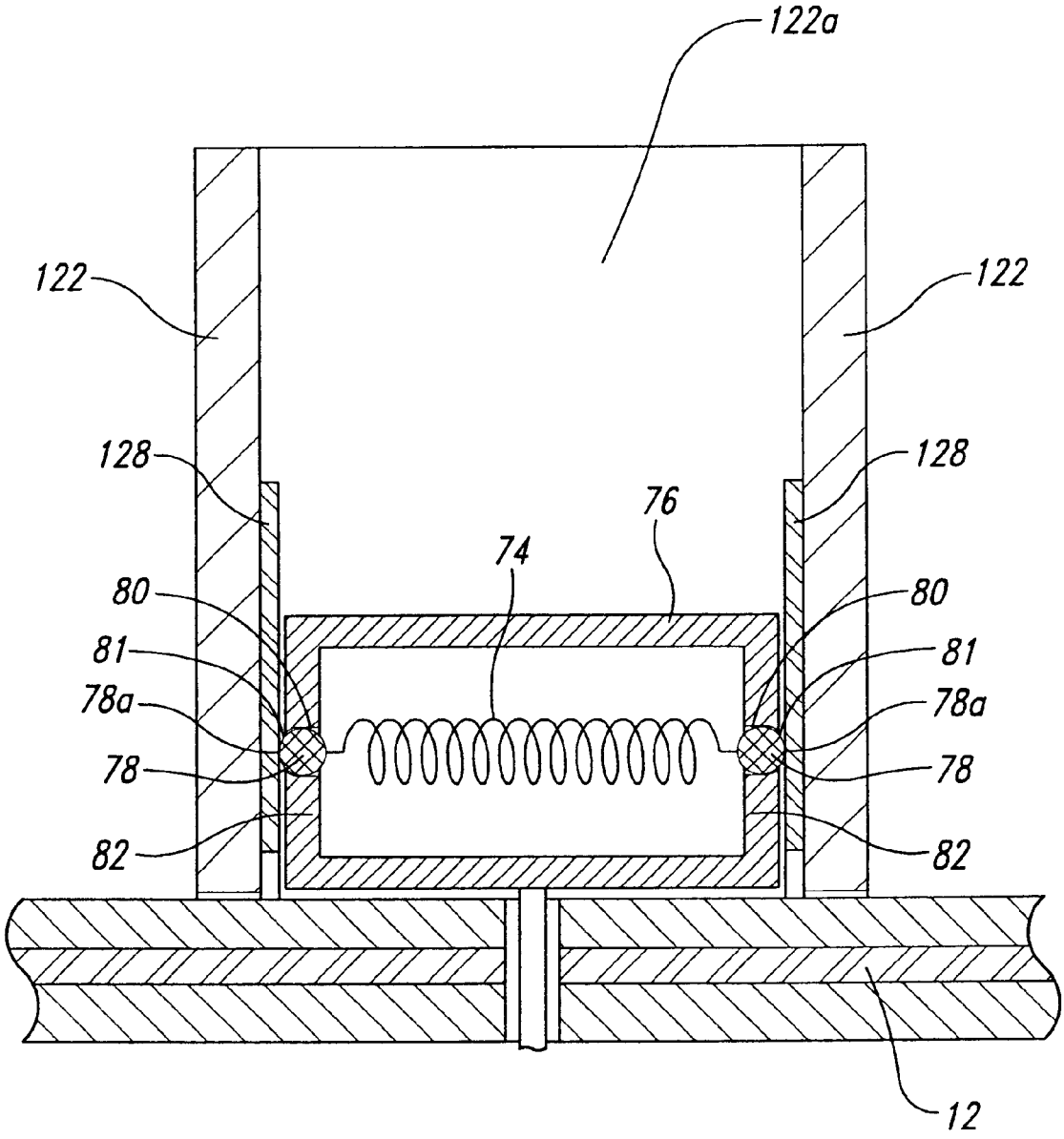
FIG. 6*b* is a detail view of the coil spring switch depicted in FIG. 6*a*.
Figure 6C:
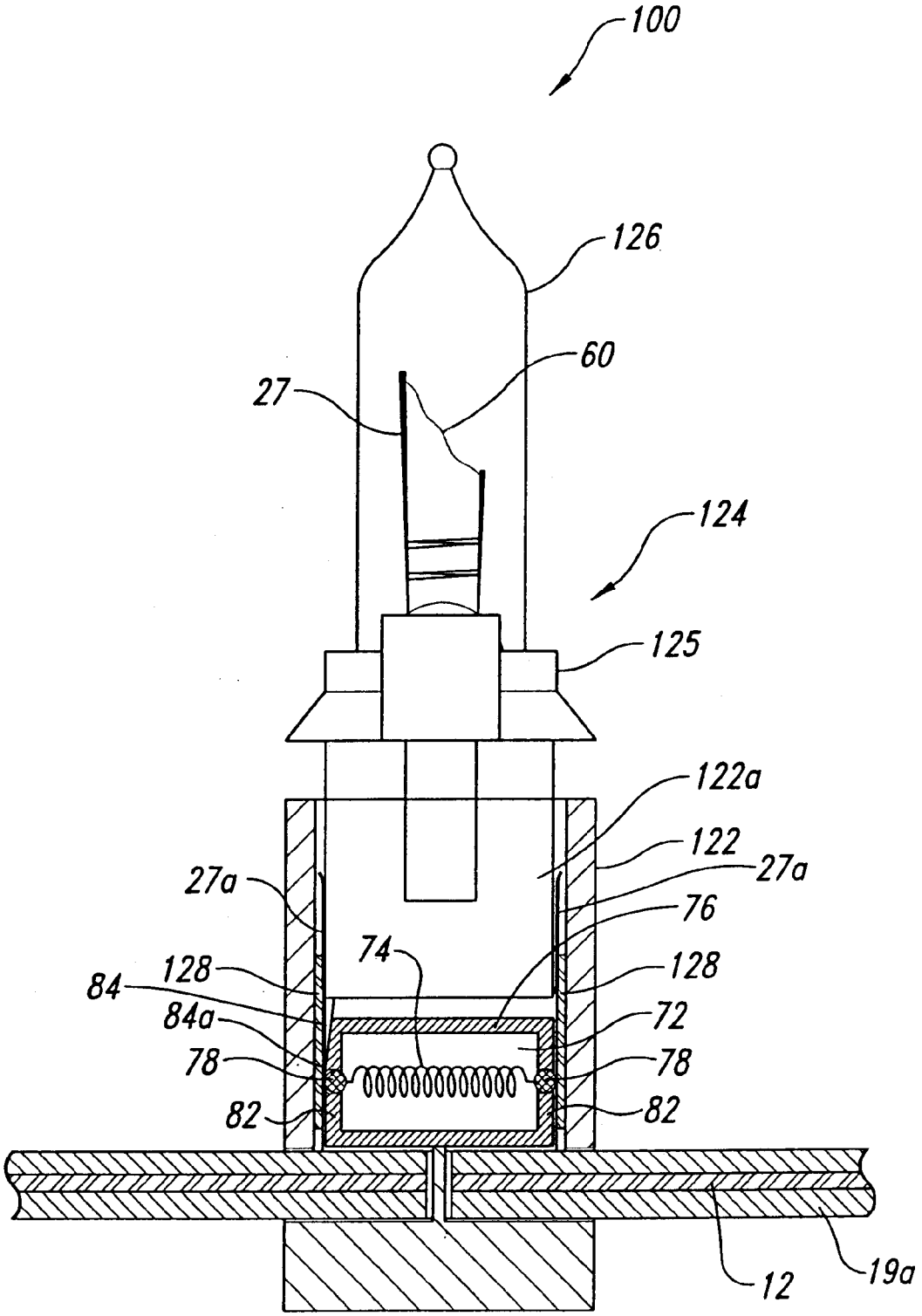
FIG. 6*c* is the light unit of FIG. 6*a* with the bulb assembly inserted within the socket cavity of the light unit.

In some alternate embodiments of the present invention, the present invention can have another type of switch, such as a coil spring. FIGS. 6*a*–6*c* show an example embodiment of a light unit 100 having a switch 72 having a coil spring 74 contained within a retaining member, or spring retainer 76. As best seen in FIG. 6*b*, the coil spring 74 has spherical contacts 78 at each end thereof. Each spherical contact 78 has a mating face 78*a* integral to an outside end portion of the spherical contact for mating with opposite contact elements 128 of the light unit 100. The coil spring 74 and the mating faces 78*a* thus form a circuit path between the opposite contact elements 128.

The axis of the coil spring 74 can be longitudinally aligned with the spring retainer 76 with the spherical contacts 78 extending through apertures 80 on vertical end walls 82 formed at left and right ends of the spring retainer 76. Each aperture 80 can have a tapered wall with the inside opening of the aperture 80 having a larger average diameter than the average diameter of the corresponding outside opening. The diameters of each outside opening can be sized to be smaller than the cross sectional diameters of center portions of the spherical contacts 78. In this manner, only end portions of the spherical contacts 78 can pass all the way through the apertures 80 to extend past outside surfaces of the end walls 82. The biasing force of the coil spring 74 urges the spherical contacts 78 outward to maintain the mating faces 78*a* beyond the end walls 82 of the spring retainer 76 for mating against the contact elements 128. Also, in some embodiments, the walls of the apertures 80 can be shaped to conform to surface portions of the spherical contacts 78 to help prevent lateral motion of the spherical contacts 78 away from the apertures 80.

As illustrated in FIG. 6*b*, a ramped surface 81 exists between the contact elements 128 and the spherical contacts 78, formed by a portion of the surface of the spherical contacts 78 curving away from the contact elements 128. As shown in FIGS. 6*a* and 6*c*, the bulb holder 125 can have an actuating member 84 made of non-conducting material, with a tapered end portion 84*a* that can be inserted between the ramped surface 81 on one of the spherical contacts 78 and a corresponding contact element 128. The tapered end portion 84*a* can then be slid downward, as represented by FIG. 6*c*, thereby opening the switch, or breaking the circuit path of the switch that passes through the coil spring 74 and mating faces. As can be seen in FIGS. 6*a* and 6*c*, opening the switch 72 and inserting the bulb assembly 24 into the socket cavity 122*a* of the socket unit 122 can be simultaneously done as displacement of the bulb assembly 24 can simultaneously displace the switch. In addition, when the bulb assembly 124 is removed, thereby removing the actuating member 84 from between one of the mating faces 78*a* and corresponding contact element 128, the coil spring 74 restores contact between the mating face 84*a* and the contact element 128, thereby closing the switch and restoring the circuit path through the switch.

Figure 6D:
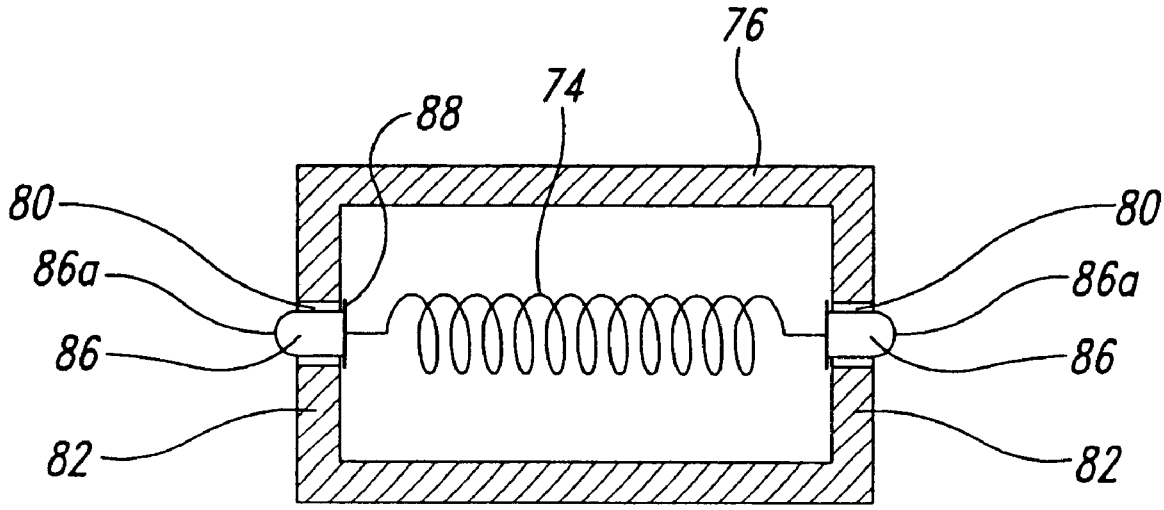
FIG. 6*d* is a detail view of an alternative embodiment of the coil spring switch depicted in FIG. 6*a*.

FIG. 6*d* shows one possible alternative embodiment for contact portions of the coil spring. In this embodiment, the spherical contacts 78 are replaced with knob contacts 86 having stoppers 88. The knob contacts 86 also have mating faces 86*a* at end portions thereof. However, the knob contacts can be configured to extend out further from the end walls 82 of the spring retainer 76, while the stoppers 88 can prevent the knob contacts 86 from being displaced all the way through the apertures of the spring retainer 76.

In the field of decorative light strings, it is known to provide a shunt between the leads of a bulb. As previously discussed, such shunts can provide alternate circuit routes through the light unit 10 when the filament of the bulb burns out. However, such shunts can fail or be defective such that a user of a light string will encounter the same problems inherent in lights strings without shunts. That is, once the filament fails on the bulb in a light string, the entire light string will go out, requiring the user to inspect each bulb on the light string to determine where the failure has occurred. Similarly, if the bulb and filament are destroyed, or the bulb separated from the bulb base (e.g., bulb holder 25), the same failure may occur.

One solution is to provide a double shunt arrangement in bulbs such that if one shunt fails, the another shunt remains. One embodiment of a double shunt arrangement is shown in FIGS. 5*a* and 5*b*. Both shunts 92 of the double shunt arrangement are connected to both leads 27 of the bulb 26.

In another embodiment, an external shunt can be provided, which can be connected to contact elements of a light unit outside of the bulb. A shunt in the bulb assembly can be used in conjunction with the external shunt. One advantage of such a combination is that the external shunt does not have to be replaced each time a bulb is replaced, thereby reducing waste.

In one example embodiment, illustrated in FIG. 8, the light unit 10 can have a primary shunt 92 disposed within the bulb 26 and connected to the leads 27*a*, as well as an secondary shunt, or external shunt assembly 90, directly connected to the contact elements 28 of the light unit. Without being bound by theory, it is noted that the secondary shunt could be provided with a thicker insulating coat than the primary shunt 92, such that when the bulb filament 60 fails, the insulating coat on the primary shunt 92 will burn off first, lowering the resistance of the primary shunt so that current can pass therethrough. In this way, when the bulb is replaced, the secondary shunt, the external shunt 90 in this case, does not have to be replaced, thereby allowing the external shunt to be reused as a backup shunt, whereas a backup shunt contained within the bulb assembly 24, such at that shown in the embodiment depicted in FIG. 5*b*, would have to be replaced with the bulb assembly.

It is also noted that an external shunt can provide an alternate circuit path through a light unit both when a bulb burns out, as well as when the bulb, or bulb assembly, is destroyed or removed from the light unit, since the shunt does not have to be removed with the bulb assembly but can remain connected to contact elements of the light unit.

Figure 7A:
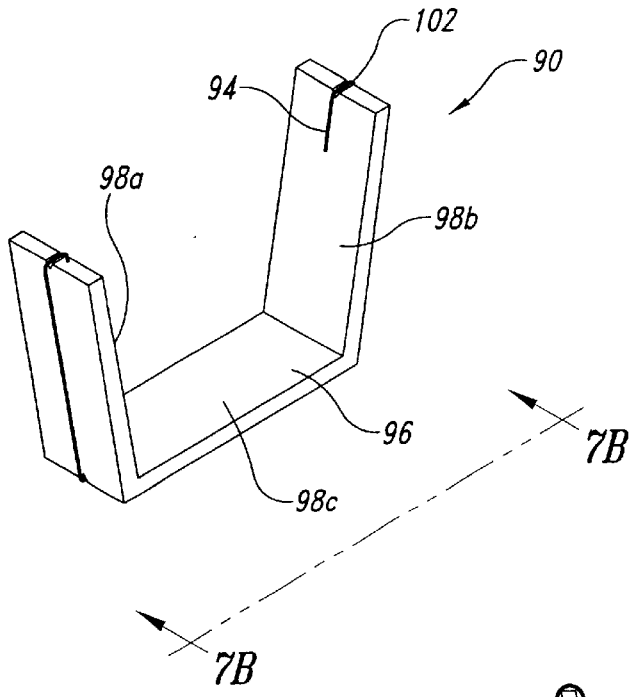
FIG. 7*a* is a perspective view of an embodiment of the shunt assembly of the present invention.
Figure 7B:
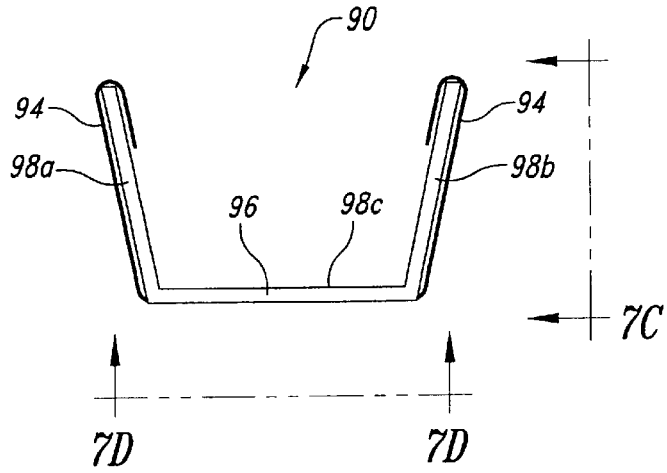
FIG. 7*b* is a elevation view of the shunt assembly of FIG. 7*a* as viewed from along line 7*b* shown in FIG. 7*a*.

Some embodiments of external shunts of the present invention are depicted in FIGS. 3, 7*a*–7*d*, 8, and 9. As can be seen in FIGS. 7*a*–7*d*, 8, and 9, one embodiment comprises a shunt assembly 90 insertable within a socket cavity 22*a* of a socket unit 22. Referring to FIGS. 7*a* and 7*b*, the shunt assembly 90 has an elongated high resistance element 94 and a retainer 96. The retainer 96 is made from a nonconducting material having elastic qualities to provide a restoring force when deformed, and is elongated with a first end portion 98*a* and second end portion 98*b*. Both end portions 98*a*, 98*b* are bent upward on one side of the retainer to extend upward away from a plane of a center portion 98*c* of the retainer 96. In the illustrated embodiment, both end portions 98*a*, 98*b* are bent less than perpendicular to the center plane.

Figure 7C:
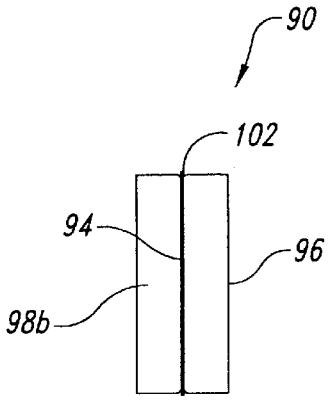
FIG. 7*c* is a side view of one end of the shunt assembly of FIG. 7*a* as viewed from along line 7*c* shown in FIG. 7*b*.
Figure 7D:
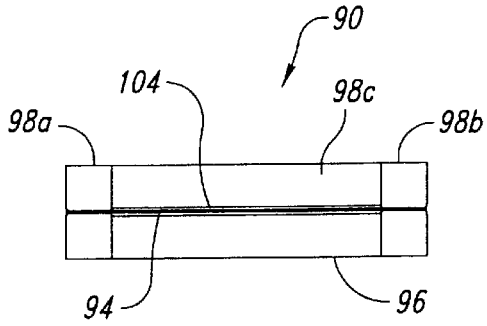
FIG. 7*d* is a bottom plan view of the shunt assembly of FIG. 7*a* as viewed from along line 7*d* in FIG. 7*b*.

As illustrated in FIGS. 7*c* and 7*d*, the high resistance element 94 is attached to a bottom and outside surface of the retainer 96, and extends longitudinally along the retainer. End portions of the high resistance element 94 extend beyond corresponding end portions 98*a* and 98*b* of the retainer 96 and are wrapped around the edges thereof to be mated against the opposite surface of the retainer 96, as is best seen in FIG. 7*b*.

Figure 9:
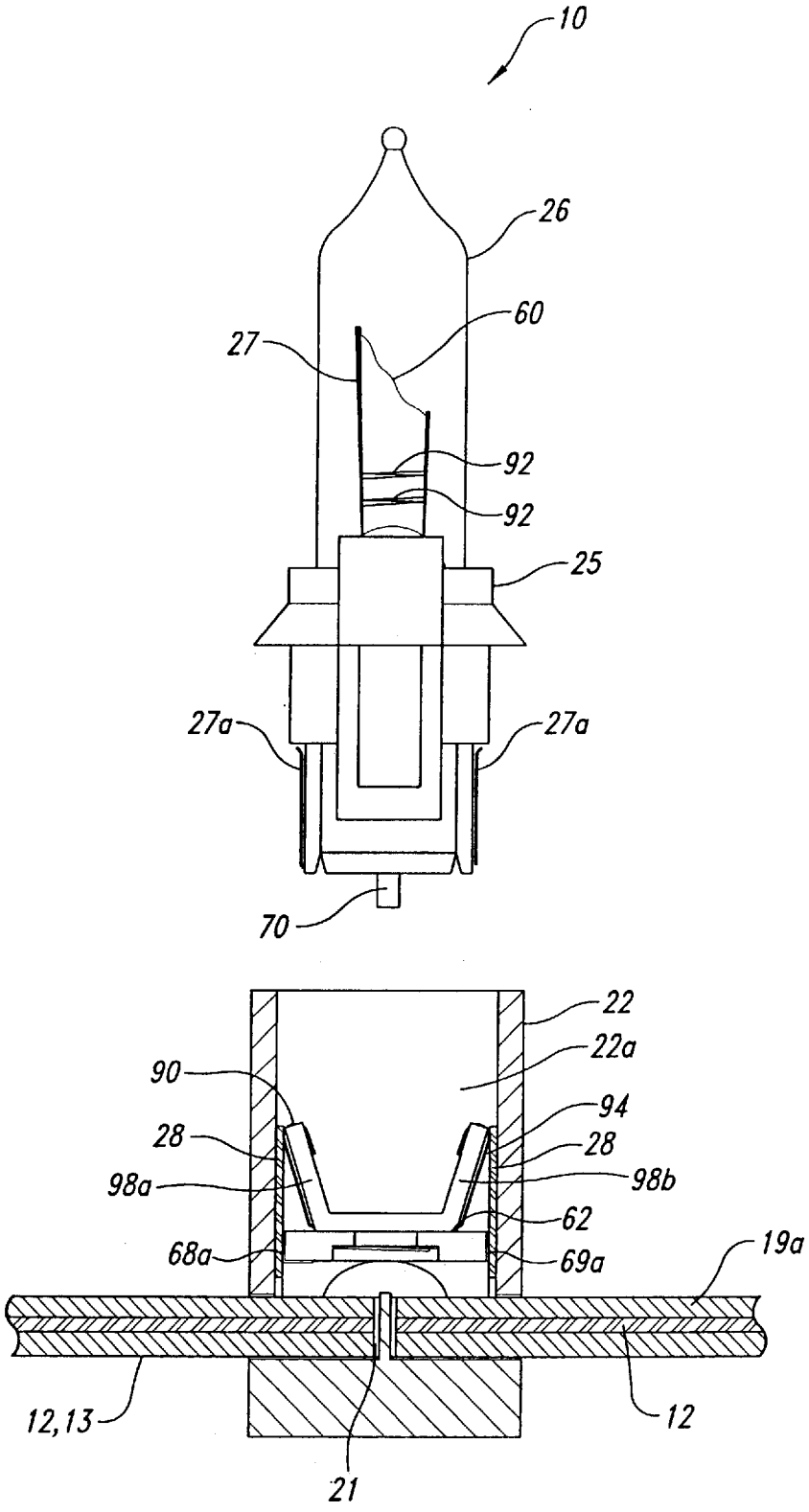
FIG. 9 is a cross sectional view of the embodiment depicted in FIG. 8, as viewed along the line 9—9 in FIG. 2.

As illustrated in FIG. 9, the shunt assembly 90 can be inserted within the socket cavity 22*a* of the socket unit 22, with portions of the high resistance element 94 in contact with the contact elements 28. In order to do so however, the upwardly bent end portions 98*a*, 98*b* of the retainer 96 must be deformed inward slightly toward one another, against a restoring force of the retainer. The restoring force of the retainer 96 can thus urge the high resistance element 94 against the contact elements 28 to ensure sufficient contact between the high resistance element 94 and the contact elements 28.

In some embodiments of the shunt assembly 90, as shown in FIGS. 7*a* and 7*c*, notches 102 can be provided on the end portions of the retainer 96 to help prevent the high resistance element 94 from moving laterally with respect to the retainer 96. Also, as illustrated in FIG. 7*d*, a longitudinal recess 104 along the bottom length of the retainer can be provided, within which the high resistance element can be partially disposed. The inventor appreciates that the high resistance element 94 can be connected to the retainer 96 in a variety of ways without deviating from the spirit of the invention.

FIGS. 8 and 9 illustrate one embodiment of a light unit of the present invention comprising both the switch 62 and the shunt assembly 90. Both the switch 62 and the shunt assembly 90 can be disposed within the socket cavity 22*a* with the shunt assembly located above the switch, and with a bottom portion of the shunt assembly resting against a portion of the horizontal wall 64*a* of the switch 62. The shunt assembly 90 is positioned off center in relation to the socket cavity 22*a*, proximate the wall of the socket cavity as can be seen in FIG. 8. The insertion end portion of the bulb assembly 24 has shoulder portions 106 having surfaces that are situated above the switch 62 providing a space between the switch 62 and the shoulder 106 within which the shunt assembly 90 can be disposed. The higher surfaces of the shoulder portions can be seen in FIG. 3, which depicts a bulb assembly 24 similar to the bulb assembly presently described.

In further embodiments comprising the shunt assembly 90, it may be necessary that an upper portion of the contact elements 28 be wider that in other embodiments. This is so the contact elements 28 can accommodate the shunt assembly 90, which is disposed off center within the socket unit 22, the contact surfaces of the contact elements needing to be wider to allow the high resistance element 94 of the shunt assembly 90 to mate against the contact elements, as can be seen in FIG. 8.

Although specific embodiments and examples of the invention have been described supra for illustrative purposes, various equivalent modifications can be made without departing from the spirit and scope of the invention, as will be recognized by those skilled in the relevant art after reviewing the present disclosure. The various embodiments described can be combined to provide further embodiments. The described devices and methods can omit some elements or acts, can add other elements or acts, or can combine the elements or execute the acts in a different order than that illustrated, to achieve various advantages of the invention. These and other changes can be made to the invention in light of the above detailed description.

In general, in the following claims, the terms used should not be construed to limit the invention to the specific embodiments disclosed in the specification. Accordingly, the invention is not limited by the disclosure, but instead its scope is determined entirely by the following claims.

What is claimed is:

1. A light unit for use with a cord and other such light units to form a light string, the light unit comprising:

a bulb assembly having first and second leads and a rigid protuberance projecting therefrom;

a socket assembly configured to engage the cord and to releasably receive the first and second leads and a portion of the bulb assembly therein, the socket assembly having first and second conductive elements therein corresponding to the respective first and second leads and configured to complete a circuit between the cord and the bulb assembly when the bulb assembly is positioned in the socket assembly;

a switch positioned within the socket assembly, the switch incorporating a conductive strip, the conductive strip having an elongated body with a fixed end and a free end, the fixed end being physically and electrically coupled to one of the first and second conductive elements to form a permanent electrical contact therewith, and the conductive strip being deflectable between a closed position in which the free end is electrically coupled with the other of the first and second conductive elements to create a short circuit across the bulb assembly between the first and second conductive elements, and an open position in which the free end is spaced apart from the closed position and the short circuit is broken; and wherein the protuberance projecting from the bulb assembly is aligned to deflect the conductive strip from the closed position to the open position when the bulb assembly is inserted into the socket assembly, and the conductive strip is sufficiently resilient to move from the open position to the closed position when the bulb assembly is removed from the socket assembly.

2. The light unit of claim 1 wherein the first and second leads constitute all of the leads.

3. The light unit of claim 1 wherein the first and second conductive elements are each independent structural elements, separable from the respective leads and the cord.

4. The light unit of claim 1 wherein the fixed end of the conductive strip is integrally formed with the free end of the conductive strip.

5. A light unit for use with a cord and other such light units to form a light string, the light unit comprising:

a bulb assembly having first and second leads and a protuberance projecting therefrom;

a socket unit configured to engage the cord and to releasably receive the first and second leads and a portion of the bulb assembly therein, the socket unit having first and second contact elements therein corresponding to the respective first and second leads and configured to complete a circuit between the cord and the bulb assembly when the bulb assembly is positioned in the socket assembly;

a switch positioned within the socket unit, the switch incorporating a first conductive strip, the first conductive strip having a fixed end and a free end, the fixed end being physically and electrically coupled to one of the first and second contact elements to form an electrical contact therewith, and the first conductive strip being deflectable between a closed position in which the free end is in contact with a second conductive strip, and an open position in which the free end is spaced apart from the second conductive strip; the second conductive strip being physically and electrically coupled to the other of the first and second contact elements, and wherein;

the protuberance projecting from the bulb assembly is aligned to deflect the at least the first conductive strip from the closed position to the open position when the bulb assembly is inserted into the socket unit, and the first conductive strip having an inherent restoring force to move from the open position to the closed position when the bulb assembly is removed from the socket unit.

6. The light unit of claim 5 wherein the first and second leads constitute all of the leads.

7. The light unit of claim 5 wherein the first and second conductive elements are each independent structural elements, separable from the respective leads and the cord.

8. The light unit of claim 5 wherein the fixed end of the first conductive strip is in direct contact with one of the first and second contact elements.

9. The light unit of claim 5 wherein the second conductive strip is in direct contact with the other of the first and second contact elements.

10. The light unit of claim 9 wherein the protuberance projecting from the bulb assembly deflects only the free end of the first conduct strip and remains spatially offset from the second conductive strip when inserted into the socket unit.

* * * * *